US008616405B2

(12) United States Patent
French et al.

(10) Patent No.: US 8,616,405 B2
(45) Date of Patent: Dec. 31, 2013

(54) DRINK CUP LID

(75) Inventors: Jordan French, Evansville, IN (US); Scott L. Fisher, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 13/554,771

(22) Filed: Jul. 20, 2012

(65) Prior Publication Data

US 2013/0020338 A1 Jan. 24, 2013

Related U.S. Application Data

(60) Provisional application No. 61/510,851, filed on Jul. 22, 2011.

(51) Int. Cl.
*A47G 19/22* (2006.01)
*B65D 3/26* (2006.01)

(52) U.S. Cl.
USPC ..... 220/713; 220/780; 220/715; 220/711; 229/404; 229/906.1

(58) Field of Classification Search
USPC ..... 220/715, 713, 711, 717, 790, 802, 780; 229/906.1, 404; 222/111
See application file for complete search history.

(56) References Cited

U.S. PATENT DOCUMENTS

| | | | | | |
|---|---|---|---|---|---|
| 5,390,810 | A * | 2/1995 | Stroble et al. | ..... | 220/281 |
| 5,894,952 | A * | 4/1999 | Mendenhall et al. | ..... | 220/713 |
| D437,223 | S * | 2/2001 | Coy et al. | ..... | D9/447 |
| 6,929,143 | B2 * | 8/2005 | Mazzarolo | ..... | 220/254.3 |
| 8,430,268 | B2 * | 4/2013 | Weiss et al. | ..... | 220/780 |
| 2002/0027139 | A1 * | 3/2002 | O'Neill | ..... | 220/254 |
| 2006/0071008 | A1 * | 4/2006 | Sadlier | ..... | 220/713 |
| 2006/0180028 | A1 * | 8/2006 | Burchard | ..... | 99/275 |
| 2006/0255038 | A1 * | 11/2006 | Hollis et al. | ..... | 220/254.3 |
| 2009/0272742 | A1 * | 11/2009 | Dybala | ..... | 220/212 |
| 2012/0024871 | A1 * | 2/2012 | Hundley et al. | ..... | 220/715 |

* cited by examiner

*Primary Examiner* — Anthony Stashick
*Assistant Examiner* — Don M Anderson
(74) *Attorney, Agent, or Firm* — Barnes & Thornburg LLP

(57) ABSTRACT

A lid is configured to mate with a brim of a cup to form a liquid container. The lid is formed to include a liquid-discharge outlet so that consumers can drink liquid stored in the cup while the lid is mounted on the brim of the cup. The lid comprises a ring-shaped brim mount adapted to mate with the brim of a cup and a central closure surrounded by the ring-shaped brim mount, wherein the central closure includes channel means for conducting any overflow liquid leaking inadvertently out of a cup coupled to the drink cup lid through the liquid-discharge outlet into the raised-liquid collection region formed in the elevated basin downwardly along a first predetermined path on an exterior surface of the elevated basin into the ring-shaped low-elevation liquid-retention channel.

30 Claims, 6 Drawing Sheets

DRINK CUP LID

PRIORITY CLAIM

This application claims priority under 35 U.S.C. §119(e) to U.S. Provisional Application Ser. No. 61/510,851, filed Jul. 22, 2012, which is expressly incorporated by reference herein.

BACKGROUND

The present disclosure relates to drink cups, and particularly to lids for drink cups. More particularly, the present disclosure relates to a lid formed to include a liquid-discharge outlet and liquid-overflow pan near the liquid-discharge outlet.

SUMMARY

According to the present disclosure, a liquid container comprises a lid adapted to mate with the brim of a cup. The lid is formed to include a liquid-discharge outlet communicating with an interior region formed in the cup when the lid is mounted on the brim of the cup so that consumers can drink liquid stored in the cup and expelled through the liquid-discharge outlet formed in the lid while the lid is mounted on the brim of the cup.

In illustrative embodiments, the lid includes a central closure formed to include the liquid-discharge outlet and a ring-shaped brim mount arranged to surround the central closure. The brim mount of the lid is configured to mate with the brim of the cup to hold the central closure in a stationary position closing a cup mouth opening into the interior region of the cup and placing the liquid-discharge outlet in fluid communication with any liquid stored in the interior region of the cup.

In illustrative embodiments, the central closure and the surrounding brim mount cooperate to form a ring-shaped low-elevation liquid-retention channel therebetween. The central closure includes an elevated basin formed to include the liquid-discharge outlet. The elevated basin rises upwardly from a floor of the liquid-retention channel and extends above the top edge of the surrounding brim mount.

In illustrative embodiments, the elevated basin is also formed to include a raised liquid-collection region located below the liquid-discharge outlet and above the low-elevation liquid-retention channel surrounding the base of the elevated basin. The elevated basin is also formed to include first and second side-discharge channels. Each side-discharge channel is configured to provide means for conducting any overflow liquid leaking inadvertently out of the container through the liquid-discharge outlet into the raised liquid-collection region formed in the elevated basin downwardly along an exterior surface of the elevated basin into the ring-shaped low-elevation liquid-retention channel.

In illustrated embodiments, the elevated basin includes an upstanding drink spout formed to include the liquid-discharge outlet in a top wall thereof, an upstanding ridge arranged to extend away from the upstanding drink spout, and a raised basin floor arranged to extend between the drink spout and the upstanding ridge to form the raised liquid-collection region. A peak of each of the upstanding drink spout and upstanding ridge and the raised basin floor is arranged to lie above the brim mount.

In illustrative embodiments, the first side-discharge channel is an inclined curved liquid-conducting channel arranged to lie along a first side of the upstanding ridge and formed to include an inlet end communicating with a first side of the liquid-collection region and an outlet end communicating with the liquid-retention channel. The second side-discharge channel is an inclined curved liquid-conducting channel arranged to lie along an opposite second side of the upstanding ridge and formed to include an inlet end communicating with an opposite second side of the liquid-collection region and an outlet end communicating with the liquid-retention channel. The first side-discharge channel winds in a clockwise direction about a vertical central axis associated with the lid from its inlet end to its outlet end while the second side-discharge channel winds in a counterclockwise direction about the vertical central axis from its inlet end to its outlet end.

In illustrative embodiments, the annular floor of the ring-shaped low-elevation liquid-retention channel is provided by an annular radially outwardly extending flange that is coupled to a perimeter edge of the base of the elevated basin and a series of liquid-retention cells aligned with cell-inlet apertures formed in the flange and arranged to extend downwardly from the flange in a direction away from the elevated basin. Any overflow liquid discharged from the elevated basin into the liquid-retention channel will begin to fill these liquid-retention cells that are designed and configured to trap liquid therein to minimize sloshing and splashing of liquid flowing into the liquid-retention channel from higher elevations in the elevated basin.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 9 is a partial perspective view of the lid of FIG. 8, with portions of the brim mount broken away to reveal a series of cell-inlet apertures formed in an annular radially outwardly extending flange that is coupled to a base of the elevated basin and showing that a downwardly extending liquid-retention cell is provided for each cell-inlet aperture;

FIG. 10 is another partial perspective view of the lid of FIG. 8; and

FIG. 11 is an enlarged partial perspective view taken from a circled region of FIG. 9.

DETAILED DESCRIPTION

Figure 1:
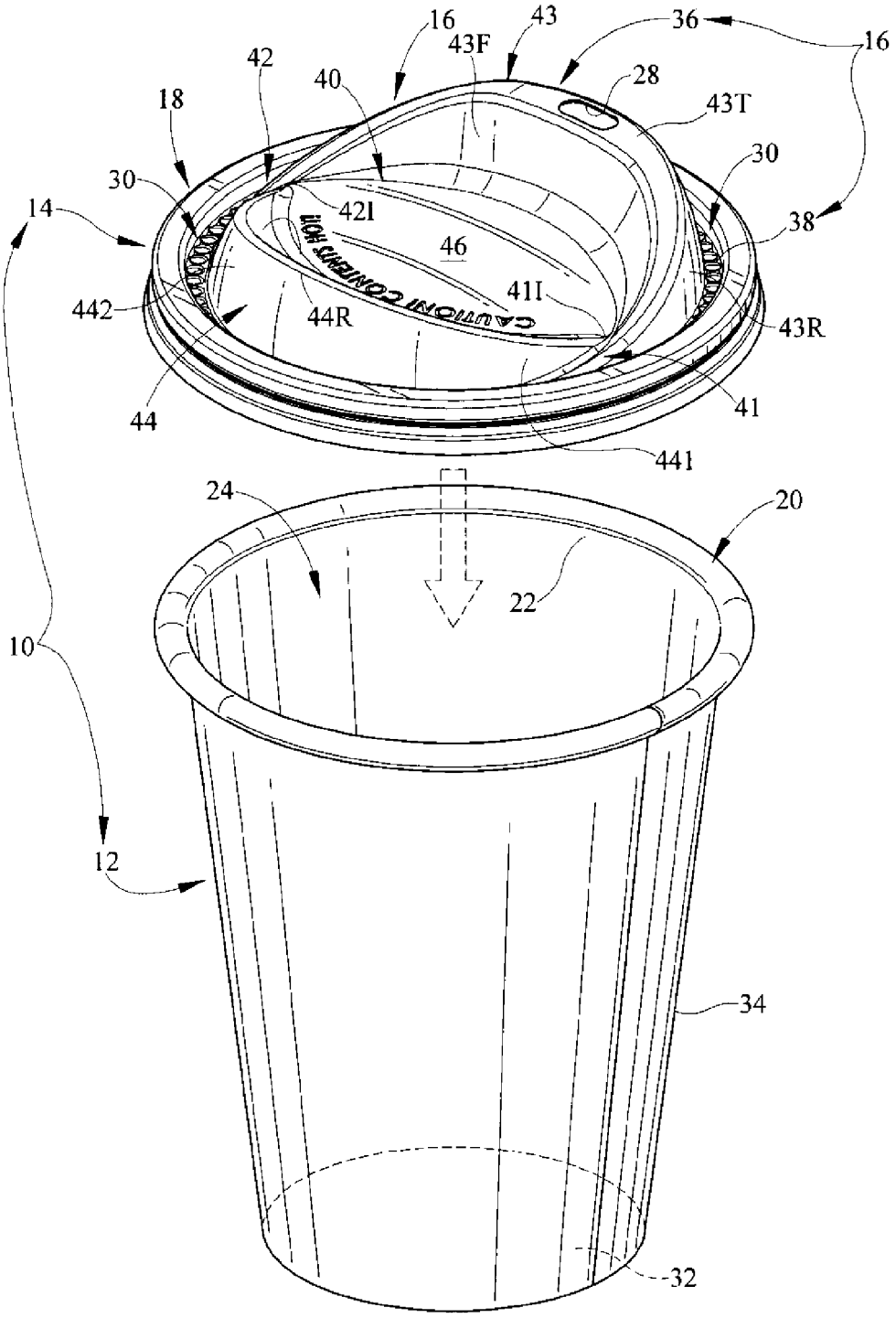
FIG. 1 is a perspective view of a lid in accordance with the present disclosure and a cup before the lid is mounted on the cup and showing that the lid includes a ring-shaped brim mount adapted to mate with the brim of the cup and a central closure surrounded by the brim mount and showing that the closure cooperates with the brim mount to define a ring-shaped low-elevation liquid-retention channel surrounding a base of an elevated basin and suggesting that the elevated basin is formed to include a liquid drainage system for conducting any leaking liquid discharged from a high-elevation liquid-discharge outlet formed in the elevated basin downwardly along several liquid flow paths into the ring-shaped low-elevation liquid-retention channel for storage therein as suggested in FIG. 8.
Figure 2:
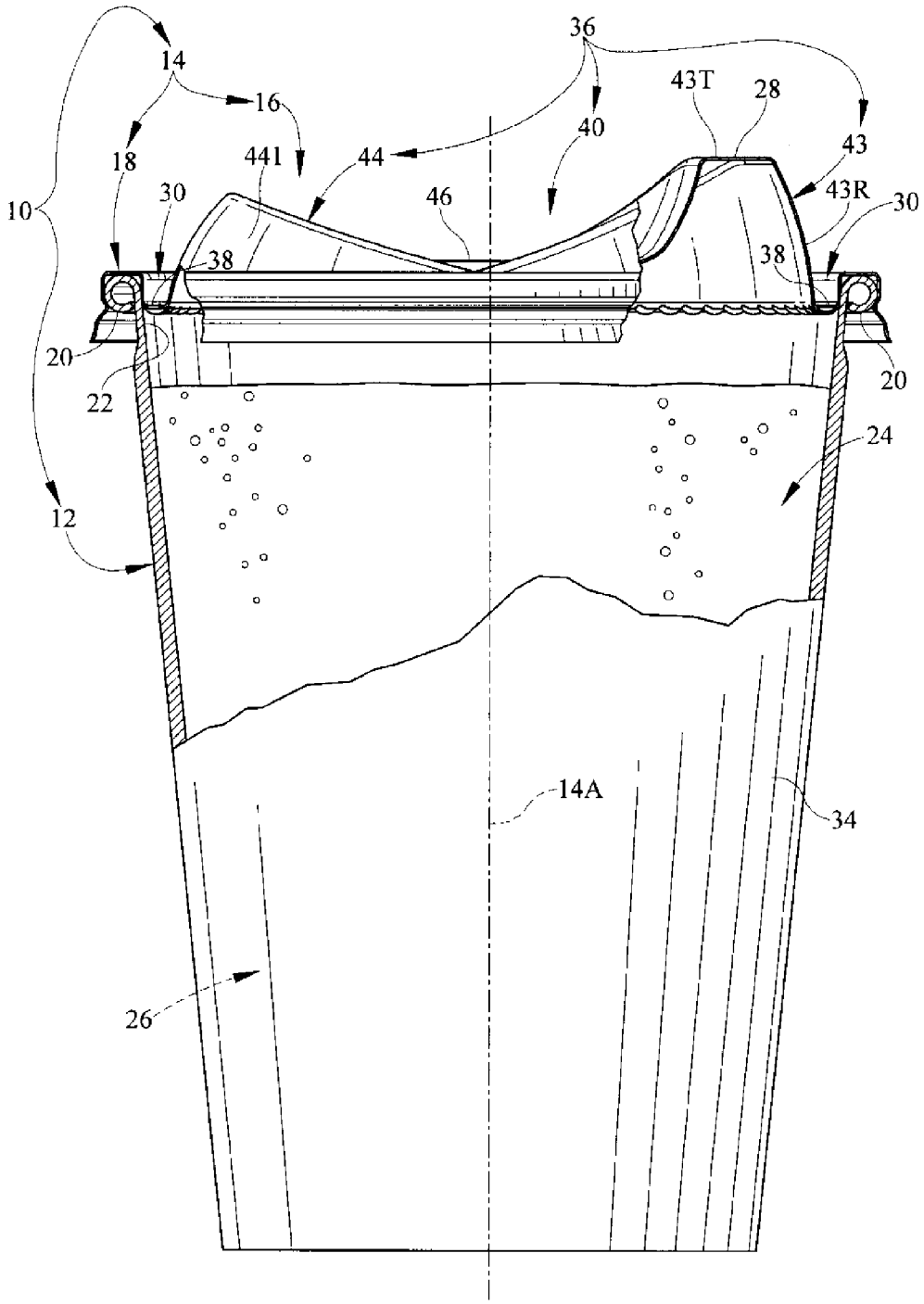
FIG. 2 is an enlarged side elevation view of the container of FIG. 1, with portions broken away, after the lid has been mounted on the brim of the cup and showing that the central closure rises upwardly above the brim mount and includes an upstanding drink spout (on the right) that is formed to include the high-elevation liquid-discharge outlet as shown in FIG. 1 and an upstanding ridge (on the left) and suggesting that liquid stored in an interior region of the cup is in fluid communication with the liquid-discharge outlet formed in the top wall of the upstanding drink spout.

A liquid container 10 includes a cup 12 and a lid 14 as shown in FIGS. 1 and 2. Lid 14 includes a central closure 16 and brim mount 18 coupled to closure 16 and configured to be mounted on a brim 20 of cup 12 to arrange central closure 16 to close a cup mouth 22 opening into an interior region 24 formed in cup 12 as suggested in FIG. 2. As suggested in FIG. 8, central closure 16 is formed to include a liquid drainage system for conducting any liquid 26 that leaks (for any reason) from a high-elevation liquid-discharge outlet 28 formed in central closure 16 downwardly along several liquid flow paths (e.g., 101, 102, 103) into a ring-shaped low-elevation liquid-retention channel 30 formed cooperatively by the central closure 16 and the surrounding brim mount 18. A series of liquid-retention cells 48 is coupled to an underside of a floor established by an annular radially outwardly extending flange 38 as suggested in FIGS. 9-11 and arranged to receive therein liquid flowing in liquid-retention channel 30 as suggested in FIG. 8.

As shown in FIGS. 1 and 2, cup 12 includes a brim 20, a floor 32, and a side wall 34 extending upwardly from floor 32 to brim 20. It is within the scope of this disclosure to make cup 12 out of any suitable plastics, paper, or other material(s).

In an illustrative embodiment, a consumer can drink liquid 26 stored in cup 12 while lid 14 remains mounted on the brim 20 of cup 12 through the liquid-discharge outlet 28 formed in lid 14. In an illustrative embodiment, central closure 16 of lid 14 includes a drink spout 43 formed to include liquid-discharge outlet 28. Drink spout 43 is adapted to be received in the mouth of a consumer desiring to drink liquid 26 stored in cup 12.

As suggested in FIGS. 1, 3-5, and 8, central closure 16 and brim mount 18 of lid 14 cooperate to form a liquid-retention channel 30 that is ring-shaped and positioned to lie at a relatively low elevation in lid 14. Liquid 26 leaking out of liquid-discharge outlet 28 will flow, in many cases, through the liquid-drainage system formed in central closure 16 downwardly into liquid-retention channel 30 as suggested in FIG. 8.

Figure 3:
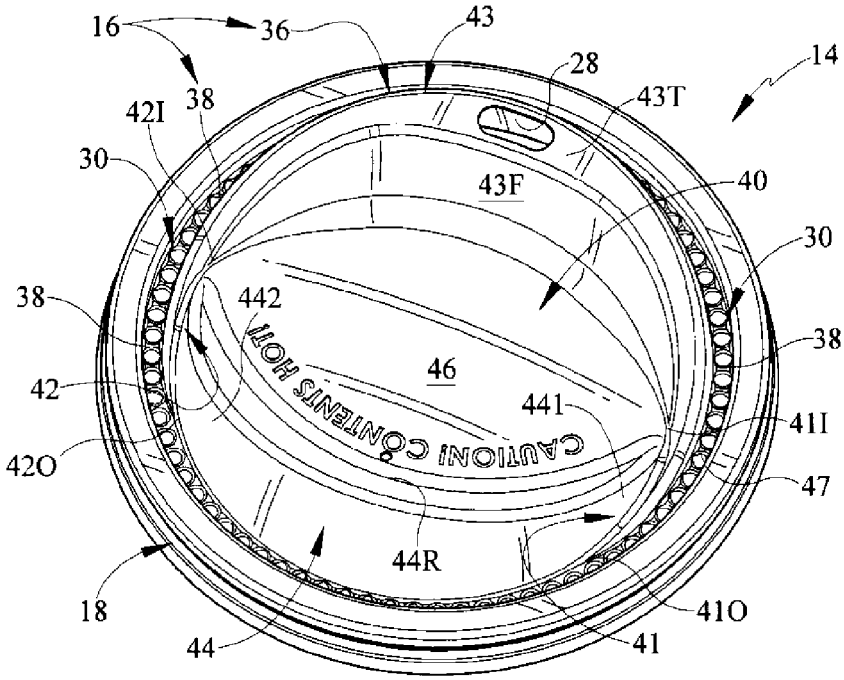
FIG. 3 is a top perspective view of the lid of FIGS. 1 and 2 taken from a FRONT vantage point showing that each of the upstanding drink spout and ridge is crescent-shaped and that the elevated basin includes a football-shaped basin floor lying between a forwardly facing concave front wall of the crescent-shaped drink spout and a rearwardly facing concave rear wall of the crescent-shaped ridge and showing that the floor of the ring-shaped low-elevation liquid-retention channel surrounding the ridge, basin floor, and drink spout is perforated to include a series of cell-inlet apertures opening into underlying liquid-retention cells.
Figure 4:
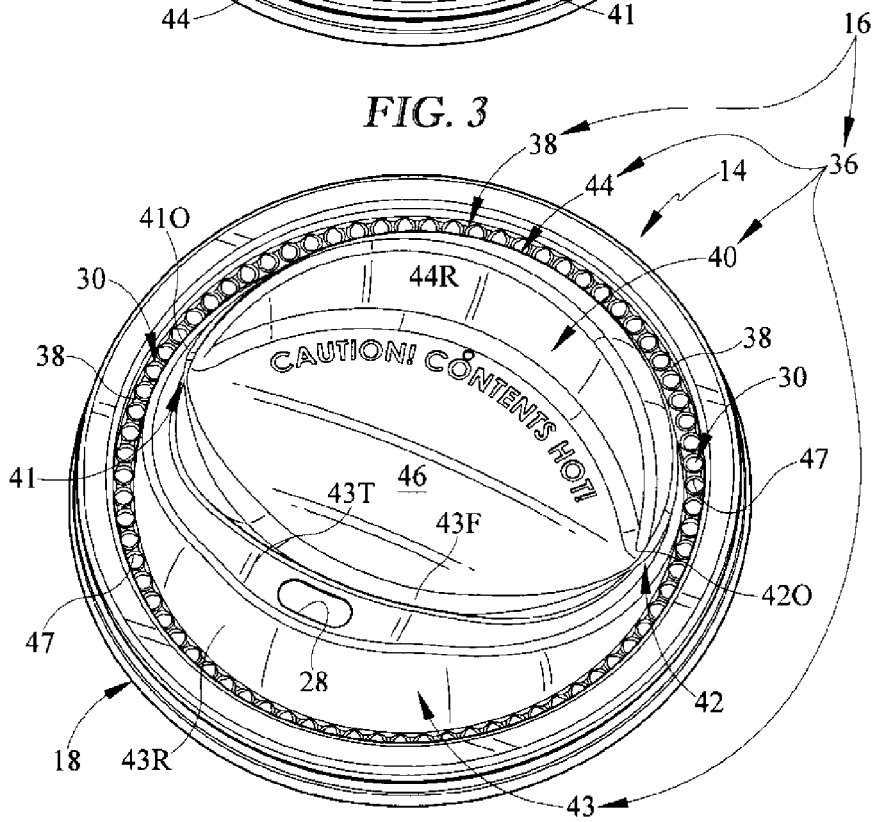
FIG. 4 is a top perspective view of the lid of FIGS. 1-3 taken from a REAR vantage point.

An elevated basin 36 included in central closure 16 is formed to include a raised liquid-collection region 40 located below liquid-discharge outlet 28 and above liquid-retention channel 30 and is also formed to include first and second side-discharge channels 41, 42 as suggested in FIGS. 1, 3, and 8. Raised liquid-collection region 40 is located and configured to receive therein at least some of the liquid 26 leaking out of liquid-discharge outlet 28 as suggested in FIG. 8. Each of side-discharge channels 41, 42 is configured to provide means for conducting any overflow liquid 26 leaking inadvertently out of container 10 through liquid-discharge outlet 28 into raised liquid-collection region 40 formed in elevated basin 36 downwardly along an exterior surface of elevated basin 36 into liquid-retention channel 30 as suggested in FIG. 8.

Figure 8:
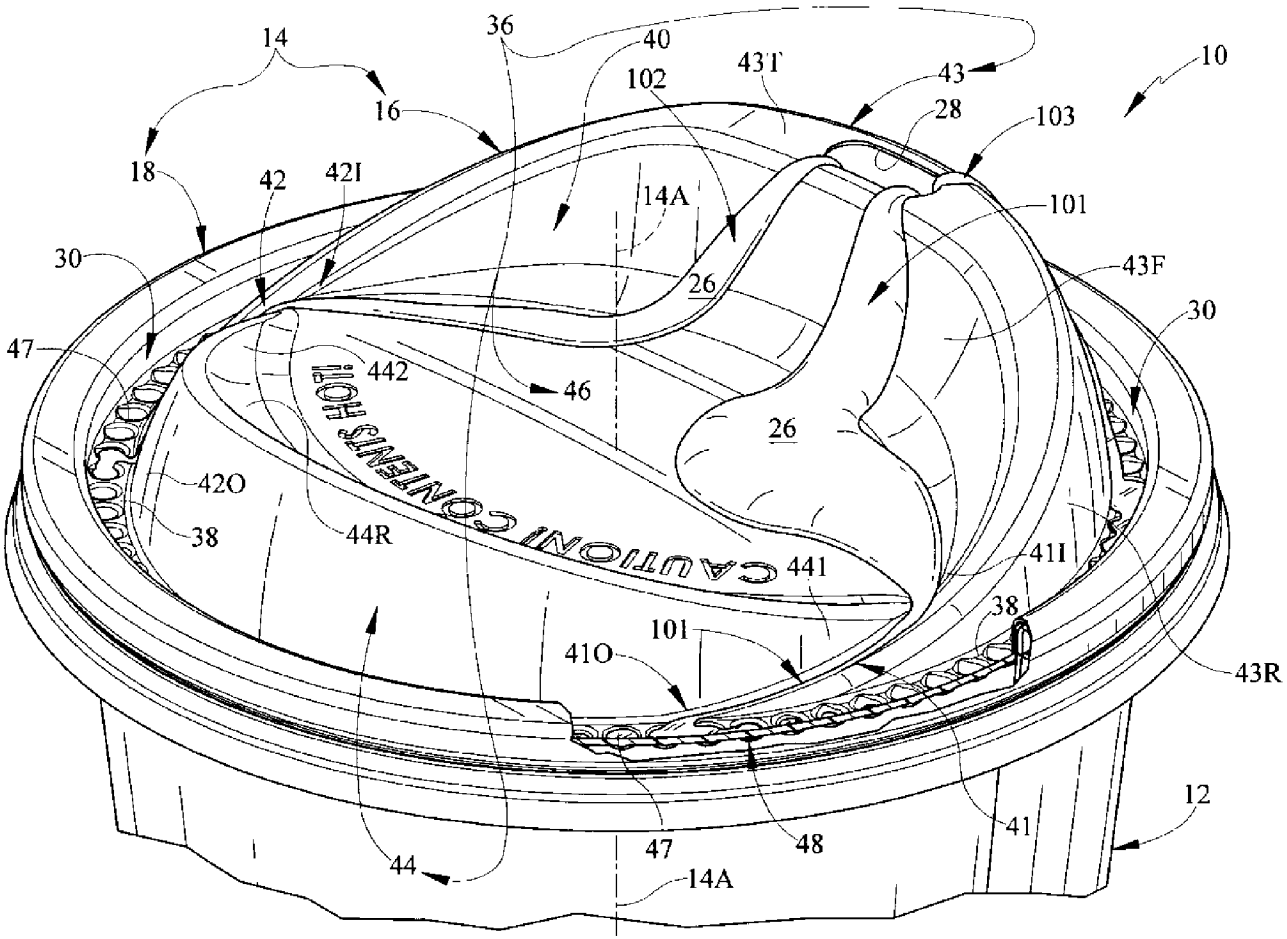
FIG. 8 is an enlarged partial perspective view of the container of FIG. 2 showing three potential flow paths of liquid leaking out of the liquid-discharge outlet formed in the top wall of the upstanding drink spout included in the elevated basin and suggesting that: (1) a first flow path is established along a right-side portion of the front wall of the upstanding drink spout and the basin floor and a first side-discharge channel (seen in the foreground) formed in the elevated basin to extend from the basin floor to the low-elevation liquid-retention channel to conduct liquid flowing along the first flow path into liquid-retention cells associated with the liquid-retention channel, (2) a second flow path is established along a left-side portion of the front wall of the upstanding drink spout and the basin floor and a second side-discharge channel (seen in the background) formed in the elevated basin to extend from the basin floor to the low-elevation liquid-retention channel to conduct liquid flowing along the second flow path into liquid-retention cells associated with the liquid-retention channel, and (3) a third flow path is established along a rearwardly facing rear wall of the upstanding drink spout directly into the low-elevation liquid-retention channel and into liquid-retention cells associated therewith.

In illustrated embodiments, elevated basin 36 includes an upstanding drink spout 43 formed to include liquid-discharge outlet 28 in a top wall 43T thereof, an upstanding ridge 44 arranged to lie in spaced-apart relation to and extend away from upstanding drink spout 43, and a raised basin floor 46 arranged to extend between drink spout 43 and ridge 44 to form raised liquid-collection region 40 as shown, for example, in FIG. 8. Raised basin floor 46 and a peak of each of drink spout 43 and ridge 44 are arranged to lie above brim mount 20 as shown, for example, in FIGS. 2 and 8.

First side-discharge channel 41 is an inclined curved liquid-conducting channel arranged to lie along a first side 441 of upstanding ridge 44 and formed to include an inlet end 41I communicating with a first side of liquid-collection region 40 and an outlet end 41O communicating with liquid-retention channel 30. Second side-discharge channel 42 is an inclined curved liquid-conducting channel arranged to lie along an opposite second side 442 of upstanding ridge 44 and formed to include an inlet end 42I communicating with an opposite second side of liquid-collection region 40 and an outlet end 42O communicating with liquid-retention channel 30. First side-discharge channel 41 winds in a clockwise direction about a vertical central axis 14A associated with lid 14 from inlet end 41I to outlet end 41O while second side-discharge channel 42 winds in a counterclockwise direction about vertical central axis 14A from inlet end 42I to outlet end 42O as suggested in FIG. 5.

Figure 9:
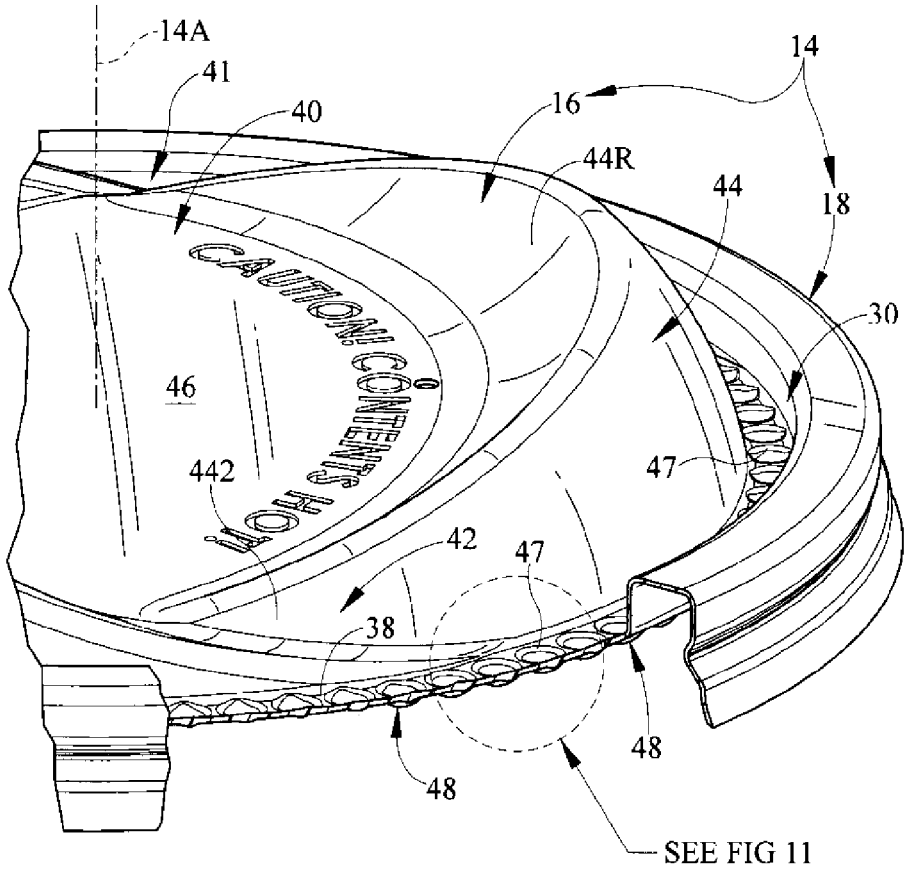
FIGS. 9-11 show liquid-retention cells formed in the central closure and associated with the low-elevation liquid-retention channel.
Figure 10:
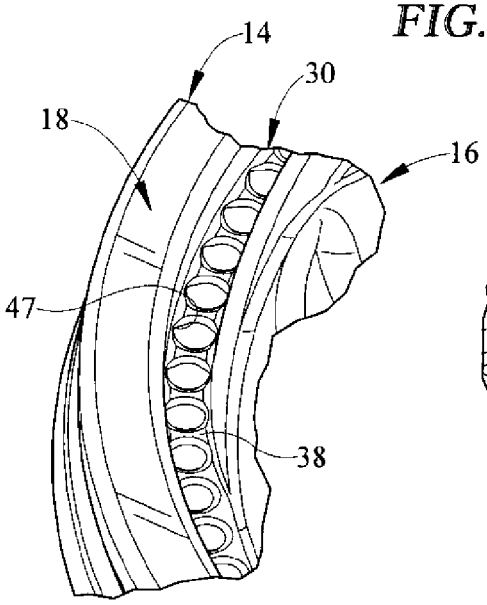
Figure 11:
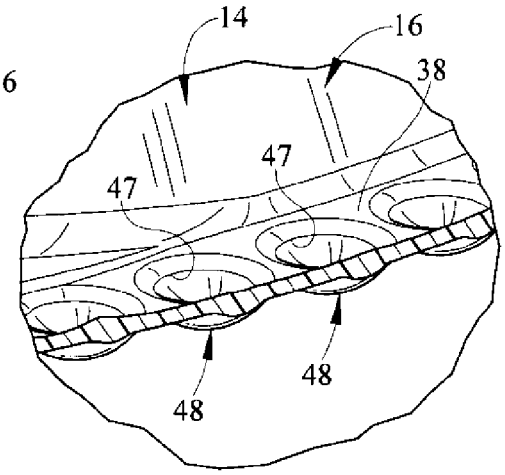

In illustrative embodiments, an annular floor of the ring-shaped low-elevation liquid-retention channel 30 is provided by an annular radially outwardly extending flange 38 that is coupled to a perimeter edge of the base of elevated basin 36 and a series of liquid-retention cells 48 aligned with cell-inlet apertures 47 formed in flange 38 as suggested in FIGS. 9-11. Liquid-retention cells 48 are arranged in a circular pattern to extend downwardly from flange 38 in a direction away from elevated basin 36 as suggested in FIG. 11. Any overflow liquid 26 discharged from elevated basin 36 into liquid-retention channel 30 will begin to fill these liquid-retention cells 48 that are designed and configured to trap liquid therein to minimize sloshing and splashing of liquid flowing into liquid-retention channel 30 from higher elevations in elevated basin 36 as suggested in FIG. 8.

Central closure 16 rises upwardly above brim mount 20 and includes an upstanding drink spout 43 that is formed to include a high-elevation liquid-discharge outlet 28 and an upstanding ridge 44 as suggested in FIGS. 1 and 2. Liquid 26 stored in interior region 24 of cup 12 is in fluid communication with the liquid-discharge outlet 28 formed in the top wall 43T of the upstanding drink spout 43 as suggested in FIG. 2.

Figure 5:
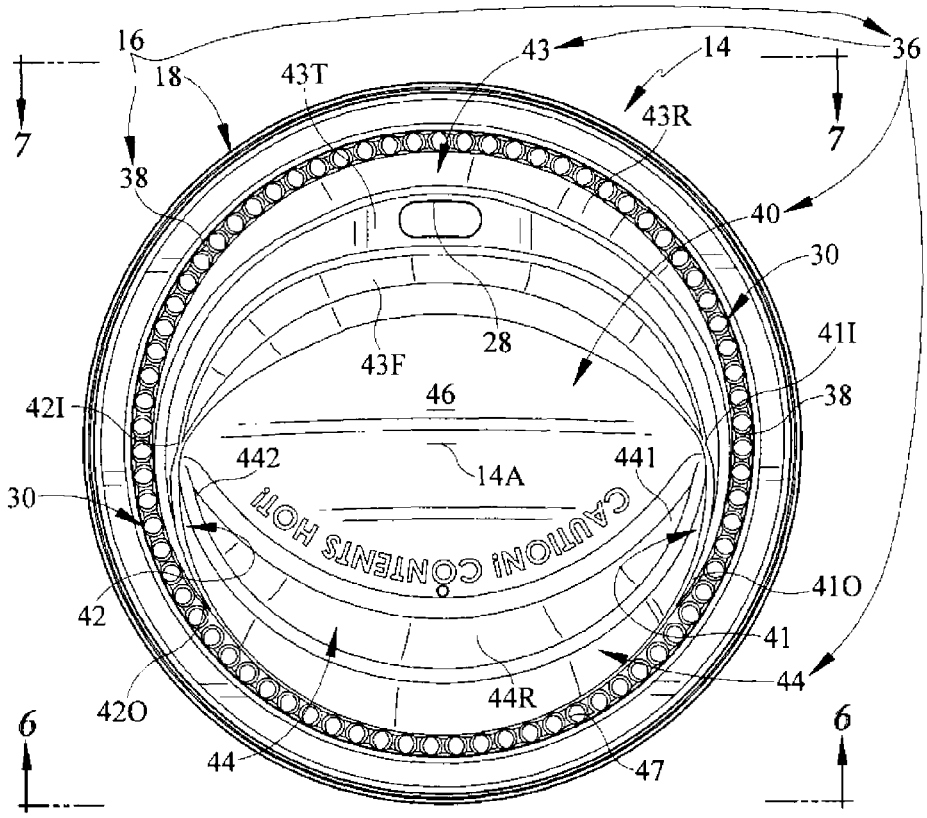
FIG. 5 is a top plan view of the lid of FIGS. 1-4 showing the perforated floor of the ring-shaped low-elevation liquid-retention channel that surrounds the forward ridge, central football-shaped basin floor, and rearward drink spout of the elevated basin.
Figure 6:
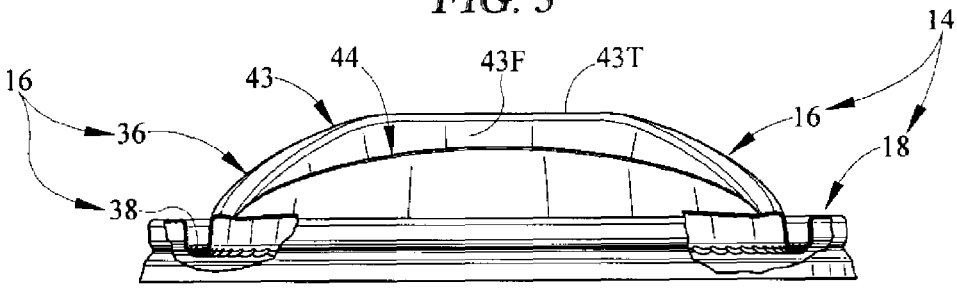
FIG. 6 is a front elevation view of the lid of FIG. 5.
Figure 7:
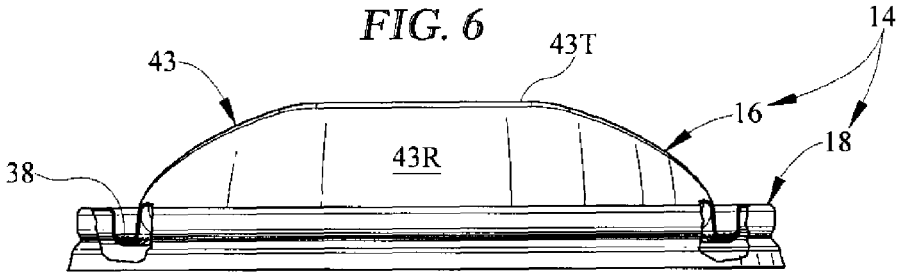
FIG. 7 is a rear elevation view of the lid of FIG. 5.

Each of the upstanding drink spout 43 and ridge 44 is crescent-shaped as shown, for example, in FIG. 5. Elevated basin 36 includes a football-shaped basin floor 46 lying between a forwardly facing concave front wall 43F of the crescent-shaped drink spout 43 and a rearwardly facing concave rear wall 44R of the crescent-shaped ridge 44. Floor 38 of ring-shaped low-elevation liquid-retention channel 30 surrounds ridge 44, basin floor 46, and drink spout 43 and is perforated to include a series of cell-inlet apertures 47 opening into underlying liquid-retention cells 48 as suggested in FIGS. 5 and 8. These liquid-retention cells 48 are round in an illustrative embodiment.

Three potential flow paths of liquid 26 leaking out of liquid-discharge outlet 28 formed in top wall 43T of upstanding drink spout 43 are included in elevated basin 36 as illustrated in FIG. 8. A first flow path 101 is established along a right-side portion of front wall 43F of upstanding drink spout 43 and basin floor 46 and a first side-discharge channel 41 formed in elevated basin 36 to extend from basin floor 46 to the low-elevation liquid-retention channel 30 to conduct liquid 26 flowing along first flow path 101 into liquid-retention cells 48 associated with liquid-retention channel 30. A second flow path 102 is established along a left-side portion of front wall 43F of upstanding drink spout 43 and basin floor 46 and a second side-discharge channel 42 formed in basin 36 to extend from basin floor 46 to low-elevation liquid-retention channel 30 to conduct liquid 26 flowing along second flow path 102 into liquid-retention cells 48 associated with liquid-retention channel 30. A third flow path 103 is established along a rearwardly facing rear wall 43R of upstanding drink spout 43 directly into the low-elevation liquid-retention channel 30 and into liquid-retention cells 48 associated therewith.

Liquid-retention cells 48 formed in central closure 16 and associated with low-elevation liquid-retention channel 30 as shown, for example, in FIGS. 9-11. Portions of the brim mount 20 are broken away to reveal a series of cell-inlet apertures 48 formed in an annular radially outwardly extending flange 38 that is coupled to a base of elevated basin 36. A downwardly extending liquid-retention cell 48 is provided for each cell-inlet aperture 47.

The invention claimed is:

1. A drink cup lid comprising a ring-shaped brim mount adapted to mate with the brim of a cup associated with the drink cup lid and a central closure surrounded by the ring-shaped brim mount, wherein the central closure includes an elevated basin arranged to extend upwardly above the ring-shaped brim mount and away from any cup mated to the ring-shaped brim mount and formed to include a spout with a liquid-discharge outlet, the central closure further includes a radially outwardly extending flange arranged to surround the elevated basin and interconnect an outer perimeter edge of the elevated basin and an inner perimeter edge of the ring-shaped brim mount to define a ring-shaped low-elevation liquid-retention channel above the radially outwardly extending flange and between the elevated basin and the surrounding ring-shaped brim mount, and the elevated basin is formed to include a raised liquid-collection region below the liquid-discharge outlet and above the ring-shaped low-elevation liquid-retention channel and to include a first side-discharge channel located between a raised upstanding ridge and the spout and interconnecting the raised liquid-collection region and the ring-shaped low-elevation liquid-retention channel to provide first channel means for conducting any overflow liquid leaking inadvertently out of a cup coupled to the drink cup lid through the liquid-discharge outlet into the raised-liquid collection region formed in the elevated basin downwardly along a first predetermined path on an exterior surface of the elevated basin into the ring-shaped low-elevation liquid-retention channel.

2. The drink cup lid of claim 1, wherein the elevated basin includes the spout as an upstanding drink spout formed to include the liquid-discharge outlet in a top wall thereof, the upstanding ridge is arranged to lie in spaced-apart relation to the upstanding drink spout, and a raised basin floor arranged to lie and extend between the upstanding drink spout and ridge and cooperate therewith to form the raised liquid-collection region.

3. The drink cup lid of claim 2, wherein each of the upstanding drink spout and the upstanding ridge is substantially crescent-shaped when viewed from above, the raised basin floor is substantially football-shaped and terminates at a first end tip and at an opposite second end tip, the raised basin floor is arranged to lie between a forwardly facing concave wall of the crescent-shaped upstanding drink spout and a rearwardly facing concave rear wall of the crescent-shaped upstanding ridge, and first side-discharge channel has an inlet end located at the first end tip of the football-shaped raised basin floor to communicate with the raised liquid-collection region and an outlet end arranged to communicate with the ring-shaped low-elevation liquid-retention channel.

4. The drink cup lid of claim 3, wherein the upstanding ridge further includes a forwardly facing convex front wall coupled to and located between the rearwardly facing concave rear wall of the upstanding ridge and a portion of the radially outwardly extending flange and the first side-discharge channel is arranged to lie between a portion of the rearwardly facing concave rear wall of the upstanding ridge and a portion of the forwardly facing concave front wall of the upstanding drink spout that is located between the raised basin floor and the radially outwardly extending flange.

5. The drink cup lid of claim 4, wherein the first side-discharge channel is curved about a vertical axis extending through the central closure.

6. The drink cup lid of claim 3, wherein the elevated basin is also formed to include a second side-discharge channel arranged to interconnect the raised liquid-collection region and the ring-shaped low-elevation liquid-retention channel to provide second channel means for conducting any overflow liquid leaking inadvertently out of a cup coupled to the drink cup lid through the liquid-discharge outlet formed in the elevated basin downwardly along a separate second predetermined path on the exterior surface of the elevated basin into the ring-shaped low-elevation liquid-retention channel and the second side-discharge channel has an inlet end located at the second end of the football-shaped raised floor basin to communicate with the raised liquid-collection region and an outlet end arranged to communicate with the ring-shaped low-elevation liquid-retention channel.

7. The drink cup lid of claim 6, wherein the upstanding ridge further includes a forwardly facing convex front wall coupled to and located between the rearwardly facing concave rear wall of the upstanding ridge and a portion of the radially outwardly extending flange and the first side-discharge channel is arranged to lie between a portion of the rearwardly facing concave rear wall of the upstanding ridge and a portion of the forwardly facing concave front wall of the upstanding drink spout that is located between the raised basin floor and the radially outwardly extending flange, and the second side-discharge channel is arranged to lie between another portion of the rearwardly facing concave rear wall of the upstanding ridge and a portion of the forwardly facing concave front wall of the upstanding drink spout that is located between the raised basin floor and the radially outwardly extending flange.

8. The drink cup lid of claim 7, wherein each of the first and second side-discharge channels is curved about a vertical axis extending through the central closure.

9. The drink cup lid of claim 6, wherein the second side-discharge channel has an inlet end located at the second end tip of the football-shaped raised basin floor to communicate with the raised liquid-collection region and an outlet end arranged to communicate with the ring-shaped low-elevation liquid-retention channel.

10. The drink cup lid of claim 9, wherein the outlet ends of the first and second side-discharge channels are separated by a first distance and the inlet ends of the first and second side-discharge channels are separated by a relatively greater distance.

11. The drink cup lid of claim 2, wherein a peak of the upstanding ridge and the top wall of the upstanding drink spout are arranged to lie above the ring-shaped brim mount.

12. The drink cup lid of claim 11, wherein the raised basin floor is arranged to lie above the ring-shaped brim mount.

13. The drink cup lid of claim 2, wherein the raised basin floor is arranged to lie above the ring-shaped brim mount.

14. The drink cup lid of claim 2, wherein the first side-discharge channel is an inclined liquid-conducting channel arranged to lie along a first side of the upstanding ridge and formed to include an inlet end communicating with a first side of the liquid-collection region and an outlet end communicating with the ring-shaped low-elevation liquid-retention channel.

15. The drink cup lid of claim 14, wherein the first side-discharge channel is curved about a vertical axis extending through a central closure and bounded by an outer convex edge lying in spaced-apart relation to the vertical axis and an inner concave edge lying between the vertical axis and the outer convex edge.

16. The drink cup lid of claim 14, wherein the elevated basin is also formed to include a second side-discharge channel arranged to interconnect the raised liquid-collection region and the ring-shaped liquid-retention channel to provide second channel means for conducting any overflow liquid leaking inadvertently out of a cup coupled to the drink cup lid through the liquid-discharge outlet formed in the elevated basin downwardly along a separate second predetermined path on the exterior surface of the elevated basin into the ring-shaped low-elevation liquid-retention channel.

17. The drink cup lid of claim 16, wherein the second side-discharge channel is an inclined liquid-conducting channel arranged to lie along an opposite second side of the upstanding ridge and formed to include an inlet and communicating with a second side of the liquid-collection region and an outlet end communicating with the ring-shaped low-elevation liquid-retention channel.

18. The drink cup lid of claim 17, wherein the outlet ends of the first and second side-discharge channels are separated by a first distance and the inlet ends of the first and second side-discharge channels are separated by a relatively greater second distance.

19. The drink cup lid of claim 17, wherein the second side-discharge channel is curved about a vertical axis extending through a central closure and bounded by an outer convex edge lying in spaced-apart relation to the vertical axis and an inner concave edge lying between the vertical axis and the outer convex edge.

20. The drink cup lid of claim 19, wherein the outlet ends of the first and second side-discharge channels are separated by a first distance and the inlet ends of the first and second side-discharge channels are separated by a relatively greater second distance.

21. The drink cup lid of claim 1, wherein the elevated basin is also formed to include a second side-discharge channel arranged to interconnect the raised liquid-collection region and the ring-shaped low-elevation liquid-retention channel to provide second channel means for conducting any overflow liquid leaking inadvertently out of a cup coupled to the drink cup lid through the liquid-discharge outlet formed in the elevated basin downwardly along a separate second predetermined path on the exterior surface of the elevated basin into the ring-shaped low-elevation liquid-retention channel.

22. The drink cup lid of claim 21, wherein each of the first and second side-discharge channels is curved about a vertical axis extending through a central closure and bounded by an outer convex edge lying in spaced-apart relation to the vertical axis and an inner concave edge lying between the vertical axis and the outer convex edge.

23. The drink cup lid of claim 21, wherein each of the first and second side-discharge channels is curved and includes an inlet end communicating with the liquid-collection region and an outlet end communicating with the ring-shaped low-elevation liquid-retention channel.

24. The drink cup lid of claim 23, wherein the outlet ends of the first and second side-discharge channels are separated by a first distance and the inlet ends of the first and second side-discharge channels are separated by a relatively greater second distance.

25. The drink cup lid of claim 23, wherein the first side-discharge channel winds in a clockwise direction about a vertical central axis from the inlet end thereof to the outlet end thereof and the second side-discharge channel winds in a counterclockwise direction about the vertical central axis from the inlet end thereof to the outlet end thereof.

26. A drink cup lid comprising a ring-shaped brim mount adapted to mate with the brim of a cup associated with the drink cup lid and a central closure surrounded by the ring-shaped brim mount, wherein the central closure includes an elevated basin arranged to extend upwardly above the ring-shaped brim mount and away from any cup mated to the ring-shaped brim mount and formed to include a spout with a liquid-discharge outlet, the central closure further includes a radially outwardly extending flange arranged to surround the elevated basin and interconnect an outer perimeter edge of the elevated basin and an inner perimeter edge of the ring-shaped brim mount to define a ring-shaped low-elevation liquid-retention channel above the radially outwardly extending flange and between the elevated basin and the surrounding ring-shaped brim mount, and the elevated basin is formed to include a raised liquid-collection region below the liquid-discharge outlet and above the ring-shaped low-elevation liquid-retention channel and to include a first side-discharge channel located between a raised upstanding ridge and the spout and interconnecting the raised liquid-collection region and the ring-shaped low-elevation liquid-retention channel to provide first channel means for conducting any overflow liquid leaking inadvertently out of a cup coupled to the drink cup lid through the liquid-discharge outlet into the raised-liquid collection region formed in the elevated basin downwardly along a first predetermined path on an exterior surface of the elevated basin into the ring-shaped low-elevation liquid-retention channel wherein the radially outwardly extending flange of the central closure is annular and formed to include a series of liquid-retention cells aligned in a one-to-one correspondence with cell-inlet apertures formed in the radially outwardly extending flange and coupled to the radially outwardly extending flange to cooperate therewith to form an annular floor of the ring-shaped low-elevation liquid-retention channel.

27. The drink cup lid of claim 26, wherein the liquid-retention cells are arranged to extend downwardly from the radially outwardly extending flange in a direction away from the elevated basin and configured to provide means for trapping overflow liquid discharged from the elevated basin into the ring-shaped low-elevation liquid-retention channel to minimize sloshing and splashing of liquid flowing downwardly into the ring-shaped low-elevation liquid-retention channel from higher elevations in the elevated basin.

28. The drink cup lid of claim 26, wherein the liquid-retention cells are arranged to lie in spaced-apart relation to one another and to extend downwardly from the radially outwardly extending flange in a direction away from the elevated basin.

29. The drink cup lid of claim 1, wherein the radially outwardly extending flange is formed to include a series of cell-inlet apertures arranged to lie in spaced-apart relation to one another and extend about the elevated basin, the central closure further includes a liquid-retention cell associated with each cell-inlet aperture and coupled to an underside of the radially outwardly extending flange and formed to include an interior region receiving liquid flowing in the ring-shaped low-elevation liquid-retention channel to trap liquid therein to minimize sloshing and splashing of liquid flowing in the ring-shaped low-elevation liquid-retention channel about the elevated basin.

30. A drink cup lid comprising a ring-shaped brim mount adapted to mate with the brim of a cup associated with the drink cup lid and a central closure surrounded by the ring-shaped brim mount and formed to include a drink spout having a liquid-discharge outlet and a radially outwardly extending flange arranged to mate with the ring-shaped brim mount to define a ring-shaped low-elevation liquid-retention channel, wherein the radially outwardly extending flange is formed to include a series of cell-inlet apertures arranged to lie in spaced-apart relation to one another and extend about a vertical axis extending through the central closure, the central closure further includes a liquid-retention cell associated with each cell-inlet aperture and coupled to an underside of the radially outwardly extending flange and formed to include an interior region receiving liquid flowing in the ring-shaped low-elevation liquid-retention channel to trap liquid therein to minimize sloshing and splashing of liquid flowing in the ring-shaped low-elevation liquid-retention channel.

* * * * *